US006796740B2

(12) United States Patent
Chiron et al.

(10) Patent No.: US 6,796,740 B2
(45) Date of Patent: Sep. 28, 2004

(54) METHOD OF AND APPARATUS FOR APPLYING VISUAL INDICATION MEANS TO A SURFACE

(75) Inventors: Paul Joseph Chiron, Box Hill (AU); Colin William Yob, Rosanna (AU); Robert Alexander Carnaby, South Grafton (AU)

(73) Assignee: Potters Industries Inc., Berwyn, PA (US)

( * ) Notice: Subject to any disclaimer, the term of this patent is extended or adjusted under 35 U.S.C. 154(b) by 0 days.

(21) Appl. No.: 10/203,167

(22) PCT Filed: Feb. 9, 2001

(86) PCT No.: PCT/AU01/00118

§ 371 (c)(1),
(2), (4) Date: Oct. 22, 2002

(87) PCT Pub. No.: WO01/59218

PCT Pub. Date: Aug. 16, 2001

(65) Prior Publication Data

US 2003/0071092 A1 Apr. 17, 2003

(30) Foreign Application Priority Data

Feb. 10, 2000 (AU) ..... PQ554

(51) Int. Cl.[7] ..... E01C 23/22; E01C 23/16

(52) U.S. Cl. ..... 404/94; 404/93; 404/84.05; 404/73; 404/14

(58) Field of Search ..... 404/72, 73, 12, 404/13, 14, 15, 93, 94, 84.05

(56) References Cited

U.S. PATENT DOCUMENTS

| | | | | | |
|---|---|---|---|---|---|
| 3,590,701 | A | * | 7/1971 | Ten Broeck | 404/84.05 |
| 4,136,991 | A | * | 1/1979 | Clark et al. | 404/73 |
| 4,792,259 | A | * | 12/1988 | Eigenmann | 404/73 |
| 5,853,263 | A | * | 12/1998 | Green | 404/94 |
| 5,934,822 | A | * | 8/1999 | Green | 404/94 |
| 6,511,259 | B1 | | 1/2003 | Khieu et al. | |

FOREIGN PATENT DOCUMENTS

| | | | | |
|---|---|---|---|---|
| DE | 3526711 | A1 | 2/1987 | |
| EP | 0 045 180 | A1 | 2/1982 | |
| FR | 2597521 | A1 * | 10/1987 | B05B/9/00 |
| WO | WO 96/34151 | | 10/1996 | |
| WO | WO 98/40166 | | 9/1998 | |

OTHER PUBLICATIONS

International Search Report dated Mar. 15, 2001.

* cited by examiner

*Primary Examiner*—Thomas B. Will
*Assistant Examiner*—Alexandra K. Pechhold
(74) *Attorney, Agent, or Firm*—RatnerPrestia

(57) ABSTRACT

Dispensing apparatus (2) for dispensing reflective elements, such as glass beads (4), onto a surface, typically a road surface, the apparatus (2) being attached to a vehicle. The glass beads (4) are placed in an inlet means (6) and directed along a path around a drive means (10), which drive means (10) imparts a velocity to the glass beads for subsequent delivery onto the surface through an outlet means (20). The glass beads (4) exit the outlet means (20) at a velocity having substantially the same magnitude as the magnitude of velocity at which the vehicle travels and a direction substantially opposite to the direction of travel of the vehicle.

30 Claims, 7 Drawing Sheets

METHOD OF AND APPARATUS FOR APPLYING VISUAL INDICATION MEANS TO A SURFACE

This is a national phase application under 35 U.S.C. § 371 of International Application No. PCT/AU01/00118, filed Feb. 9, 2001.

FIELD OF THE INVENTION

The present invention relates to a method and apparatus for applying a visible indication means to a surface, and more particularly relates to a method and apparatus for applying reflective elements as a line marking system used on road surfaces.

BACKGROUND OF THE INVENTION

Line markings, for instance on a road infrastructure are important features for separating lanes of traffic and indicating to a driver safe overtaking zones in situations where adjacent lanes have opposing directions of travel of vehicles. It also provides a clear indication of the road edge and centre line of the road with day and night visibility and are an accepted safety requirement in most countries.

Line marking to a road surface is generally made by applying a paint to the road surface, however, problems arise where over a period of years the paint surface wears and becomes faded which requires further application of the paint. Such a process is expensive and where weather conditions, such as rain, make visibility poor and particularly at night time, this creates a potential hazard to drivers of vehicles where the lines are not clear.

Improvements have been made to increase visibility, particularly at night time, by the use of reflective elements such as glass beads in the surface of the line marking. Thus when light from a vehicle strikes the bead it is reflected back towards the driver of the vehicle enabling the driver to see the road markings and determine where the edge and centre lines lie. The process of placement of the beads within the line marking typically involves the beads falling onto an adhesive or paint stripe that has previously been applied to the road surface. When the adhesive or paint cures, the beads become fixed to the road surface. Such a process has limitations in terms of the reflectance, also known as retro-reflectivity, which limits the overall effectiveness of the road line marking. As the beads are applied to the previously painted line from a moving vehicle, they bounce and scatter having the disadvantages that the beads are either covered with the pigmented paint or adhesive and therefore provide little or no reflectance to a driver, poor and inaccurate bead distribution wherein not all of the beads are generally uniformly spread within the line and there is wastage of beads that miss the line and therefore do not get adhered thereto. Furthermore the retro-reflectivity may be biased according to the direction of application onto the road surface so that it is generally difficult to have beads that provide the same or similar reflectance both ways in terms of direction of travel of vehicles and especially for night time conditions. The excessive waste due to the beads not falling within the line marking is expensive and inefficient.

Wet weather places a further demand on the performance of road line marking. Typically minimal retro-reflectivity has been possible with wet road conditions due to the nature and placement of the beads. Road safety requirements are developing to a level where road line visibility will be a regulated requirement in wet night time conditions and as a consequence, the value of road line marking is linked to the level of retro-reflectivity that can be generated.

Road line marking is generally carried out at speed and as such, any objects being delivered from the vehicle will have a similar velocity such that when they contact the road surface they will roll or bounce unless the delivery system has the ability to control the placement.

The present invention seeks to overcome or ameliorate one or more of the disadvantages by providing a method and apparatus for applying reflective elements to a surface in such a way as to minimise rolling, bouncing and loss of control over the reflective element movement during application of the elements to the surface.

SUMMARY OF THE INVENTION

According to a first aspect of the invention there is provided dispensing apparatus for dispensing visual indication means onto a surface, said apparatus being attached to a vehicle and said visual indication means being applied to a previously marked region on said surface, said dispensing apparatus comprising:

inlet means for receiving said visual indication means;

outlet means for dispensing said visual indication means onto said surface;

drive means for driving said visual indication means along a path from said inlet means to said outlet means such that said visual indication means contact a surface of said drive means thereby imparting a predetermined velocity to said visual indication means;

wherein said visual indication means exit said outlet means at a velocity that has a magnitude substantially the same as the magnitude of velocity at which said vehicle travels and a direction that is substantially opposite to the direction of travel of said vehicle.

Preferably the visual indication means are reflective elements, such as glass beads. The drive means may include a rotor or drum having its rotational speed controlled in proportion to the velocity of travel of the vehicle. A feedback-type arrangement may be used to keep the exit velocity of the reflective elements substantially the same in magnitude but substantially opposite in direction to the velocity of the vehicle.

Said drive means may be housed in a drive housing and defining a gap between an interior surface of said housing and an exterior surface of said drive means. Said reflecting elements may be directed through said gap as part of the predefined path wherein said exterior surface of said drum contacts said reflective elements to enable said reflective elements to have the requisite velocity on exit from the outlet means.

According to a second aspect of the invention there is provided a method of applying visual indication means to a surface from a moving vehicle, wherein said visual indication means are dispensed from dispensing apparatus attached to said vehicle;

said method comprising the steps of:

loading said visual indication means to said dispensing apparatus;

imparting a predetermined velocity to said visual indication means through a drive means, said drive means driving said visual indication means along a path from inlet means of said dispensing apparatus to outlet means of said dispensing apparatus such that said visual indication means contact a surface of said drive means;

dispensing said visual indication means from said drive means onto a previously marked region of said surface;

such that the exit velocity of said visual indication means from said dispensing apparatus is substantially the same in magnitude as the velocity of travel of the vehicle but substantially opposite in direction to the direction of travel of the vehicle.

The method may further comprise the step of marking said region with a material capable of adhesion to said surface, such as a suitable adhesive material or paint prior to the application of said visual indication means, which may be reflective elements. The drive means may be controlled in accordance with the velocity of the vehicle through, for example a feedback arrangement, such that the angular speed of the drive means that imparts a velocity to the reflective elements is adjusted depending on the velocity of the vehicle.

The method may further comprise the step of comparing the angular speed or velocity of the drive means with the velocity of travel of the vehicle and controlling said angular speed in accordance with the velocity of travel of the vehicle.

BRIEF DESCRIPTION OF THE DRAWINGS

A preferred embodiment of the invention will hereinafter be described, by way of example only, with reference to the drawings wherein.

DETAILED DESCRIPTION OF PREFERRED EMBODIMENTS

Figure 2:
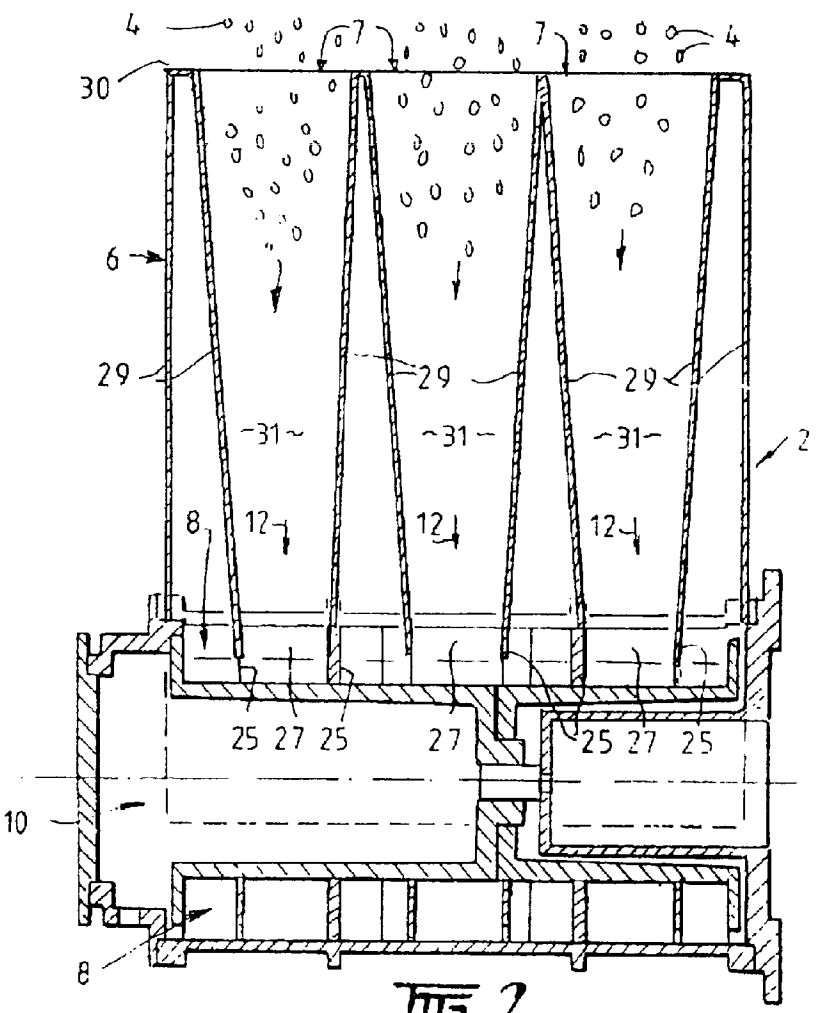
FIG. 2 is a front view of a portion of the dispensing apparatus of FIG. 1.
Figure 1:
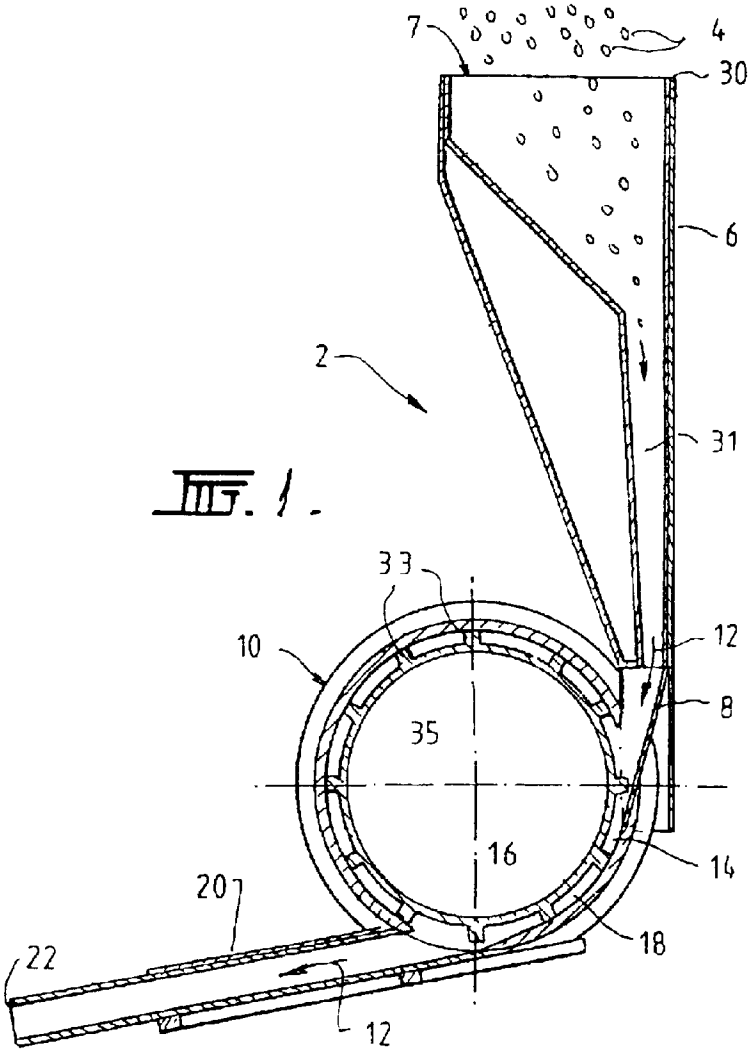
FIG. 1 is a side view of apparatus for dispensing visual indication means to a surface, and more particularly to dispensing apparatus for dispensing reflective elements, such as glass beads, to a road surface.

With reference to FIGS. 1 and 2 there is shown apparatus 2 for dispensing visual indication means, such as reflective elements, to a surface and in particular to a road surface. The reflective elements, in the form of glass beads 4, are placed into an inlet means or inlet housing 6 which are fed from a storage container (not shown) at a rate which is dependent on a number of characteristics, such as the speed of the vehicle to which the dispensing apparatus is attached, the width of the line marking or road line dimension requirements, bead characteristics and the quantity of beads required to be placed on a particular line. The inlet means controls the flow of beads through a template or cassette 8 that is used to regulate the width and separation of the distribution on the road line marking. It is to be understood however that the invention can operate without a template in situations where a single line requires application of the beads 4 in which case the line width may be limited to a particular configuration. Where multiple lines require such application, then the template or cassette 8 is used to prevent disruption to the flow of the beads 4 through the partitions 29 of the inlet means 6.

The apparatus 2 is designed to enable multiple applications of glass beads 4 to adjacent lines and provides for varying line widths, which can occur from region to region, or from state to state. Thus it can be set up to allow beads 4 to be applied continuously onto a fully painted line (for example where the full line forms one line of a "double line" in the centre of a road, to prevent overtaking by vehicles in the lane closest to that line) and non-continuously onto an adjacent broken line (where for example this broken line forms the other line in the "double line" in the centre of the road, to permit overtaking by vehicles in the lane closest to the broken line). Corresponding banks of spray guns may be attached to the line marking vehicle to apply the adhesive material before the beads 4 are applied. Thus a variety of line patterns may be reproduced in a single pass of the vehicle applying the adhesive material and glass beads. The varying widths of the lines is permitted by use of a combination of templates and partitions in the inlet and outlet means to be hereinafter described. Accordingly one line or more may be painted and have beads applied thereto in a single pass.

The template 8 has a number of partitions 25 that define a space 27 through which the beads 4 are guided as they enter the path of travel around the drive means 10. The template 8 is replaceable and may be interchanged with other templates that provide partitions 25 in different arrangements, thereby varying the spaces 27 through which the beads 4 can travel. Thus the template 8 may be a cassette that provides flexibility of widths of the required line pattern as beads 4 are metered into the apparatus 2. The partitions 25 may provide a support for further partitions 29 that extend up to an upper end 30 of the inlet means 6 which guide the beads 4 through a chute 31. The partitions 29 are also adjustable to provide different sized chutes 31 to match the size of the spaces 27 in the template 8. As can be seen from FIG. 2 the chutes 31 are narrower at their lower end than at their upper end 30.

Once the beads are fed through the template 8 they are drawn downwardly by gravity into the path of a rotating variable speed drive means 10, in the form of a drum or rotor. The direction or path that the beads take is shown by arrows 12 whereby the beads 4 are squeezed through a gap 14 between the outer surface 16 of the rotor 10 and the drum housing 18. The surface 16 of the rotor 10 is designed from a material that has surface properties that allow the beads 4 to be carried along a path through the gap 14 to gather speed so that the beads have the correct velocity and motion when they exit from an outlet means 20 such as a chute at the edge 22. The gap 14 is of such dimension that the beads 4 are in contact at various times with the surface 16 of the drum 10 which enables the launching of the beads 4 into the outlet means 20.

Figure 3:
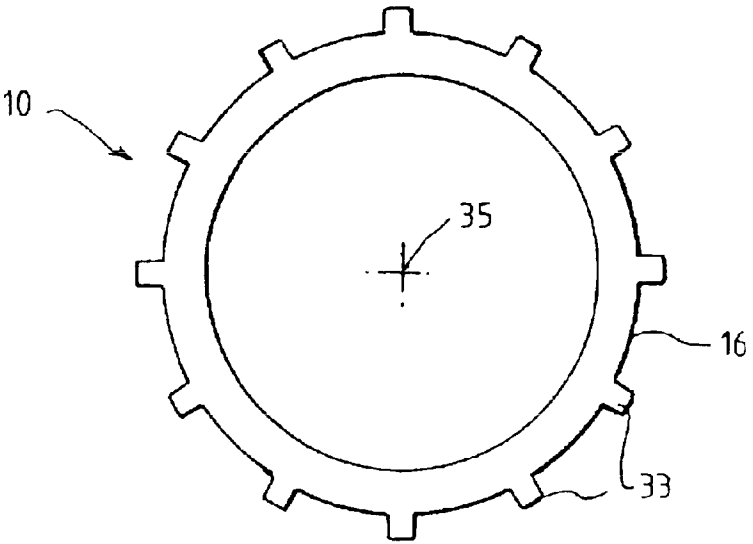
FIG. 3 is a side view of drive means of said apparatus.

The surface 16 of the rotor 10 has a series of ribs 33 (best seen with reference to FIG. 3) that extend longitudinally along the entire length of the rotor surface 16, being substantially parallel with a central longitudinal axis 35. The ribs 33 assist in collecting and separating the glass beads 4 as they enter the gap 14 on their way to the outlet means 20, and helps control the bead velocity, rotation and quantity of beads.

Figure 4:
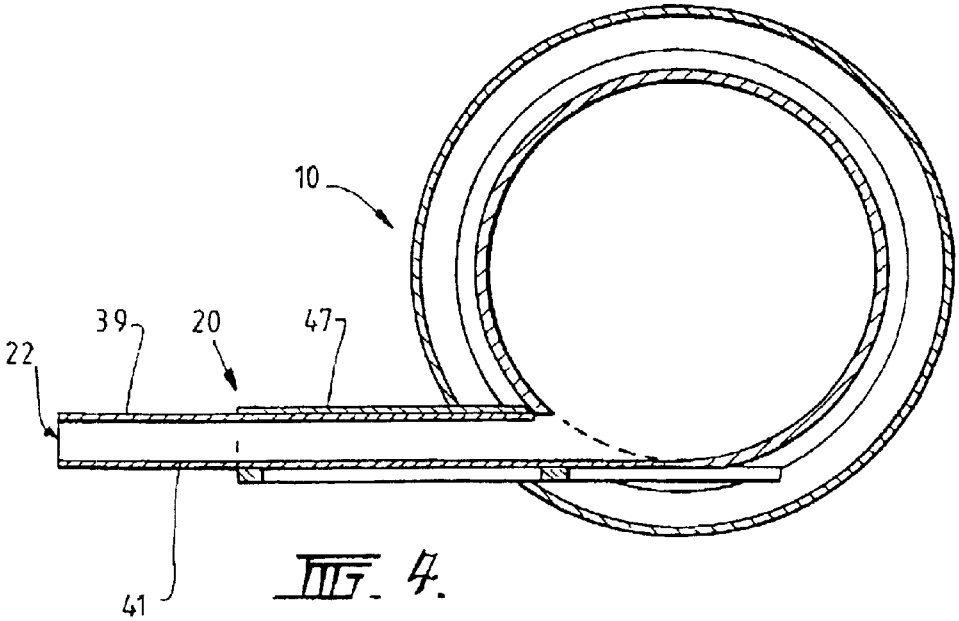
FIG. 4 is a side view of outlet means and the drive means housing of the apparatus.
Figure 5:
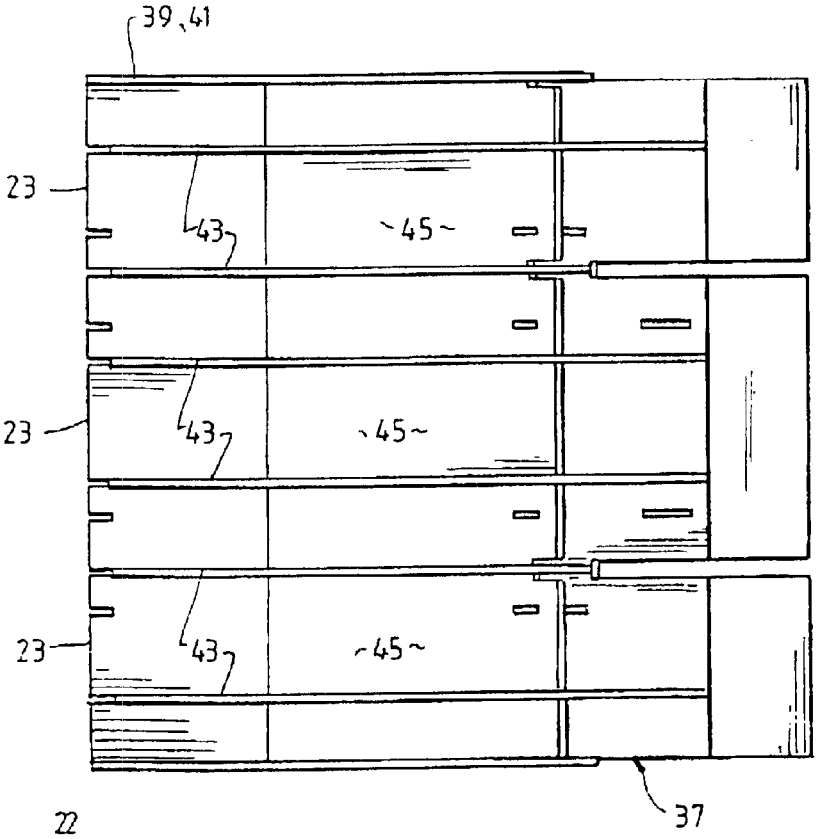
FIG. 5 is a plan view of the outlet means of the dispensing apparatus.

The outlet means 20 is more clearly seen in FIGS. 4 and 5. The outlet means 20 comprises a template 37 defined by a first (upper) plate 39, a second (lower) plate 41 and a series of partitions 43. Different templates 37 exist having different arrangements of partitions whereby the distance between partitions forming a chute or channel 45 varies to preferably match equivalent spaces 27 of template 8 and/or allow for different sized channels 45. However, it is to be understood that the corresponding channels 45 and chutes 31 may not be exactly the same dimensions. The template or cartridge 37 slides into a housing 47 that abuts against the drive means 10, or outer housing 18. The template is open-ended at either end to allow passage of the beads 4 from the path or gap 14 through the outlet means 20 onto the road surface.

The speed of the rotor 10 is linked through a feedback system to a device that measures the speed of the road marking vehicle to which the dispensing apparatus 2 is attached and is one of the variables that is considered in controlling the speed of the rotor 10. The rotor 10 may be driven by any suitable means such as a hydraulic, pneumatic electrical or other type of motor. Preferably an electric motor is used as it makes use of a very compact high field intensity permanent magnetic motor. This may be placed within the rotor 10 making the unit more compact and modular. Whatever means is used to rotate the rotor 10, it need not be limited to being housed within the rotor 10.

Once the beads 4 exit the outlet means 20 at point 22 they are directed onto the road surface within the outer widths or boundaries of the line that has just been created by application of a paint or adhesive system from a suitable paint or adhesive dispensing means which is attached to the vehicle.

The speed at which the beads exit the outlet means 20 is substantially identical in magnitude to the speed of the vehicle but directed in an opposite sense. For example if the speed of the vehicle is 40 kph, then the approximate speed that the beads exit the outlet means 20 is at 40 kph in the opposite direction to the direction of travel of the vehicle. Therefore the beads are essentially controlled so that when they fall into the paint or emulsion on the road surface they have substantially no velocity and they do not bounce or roll from the painted line. Thus the beads have minimal or substantially zero velocity in forward, backward and sideways directions. Therefore control is applied to the level of retro-reflectivity of the line marking such that the directional retro-reflectivity can be regulated. For example, if there is a one-directional line then it is possible to bias the placement of the beads and therefore the retro-reflectivity so that it is higher in the preferred direction.

The glass beads that land in the paint or adhesive material exit from the chute 20 at a predetermined level in order to allow the correct level of penetration into the paint surface and the orientation is controlled such that no forward movement is allowed once they are in the paint or adhesive surface.

The spinning of the rotor inside the housing 18 together with the partitions controls the spread of the glass beads 4. Glass beads 4 enter the inlet means 6 through various apertures 7 and exit the outlet means 20 across the width of the respective apertures 23 of the outlet means 20 (see FIG. 5). The exit width of the channels 45 are generally narrower in width than the width of the line mark. The width of the channels 45 will depend on the angle and height above the road surface of the outlet means 20. Some examples of the widths of channel 45 to the line are 45 mm/80 mm, 75 mm/100 mm and 115 mm/150 mm. The hydraulic motor used to rotate the rotor 10 may be housed within the hub of the rotor or may be separately attached. If for example a hydraulic motor is used then the oil is supplied from a hydraulic pump and the flow of the oil is controlled so as to provide the required number of revolutions of the rotor 10.

Figure 6:
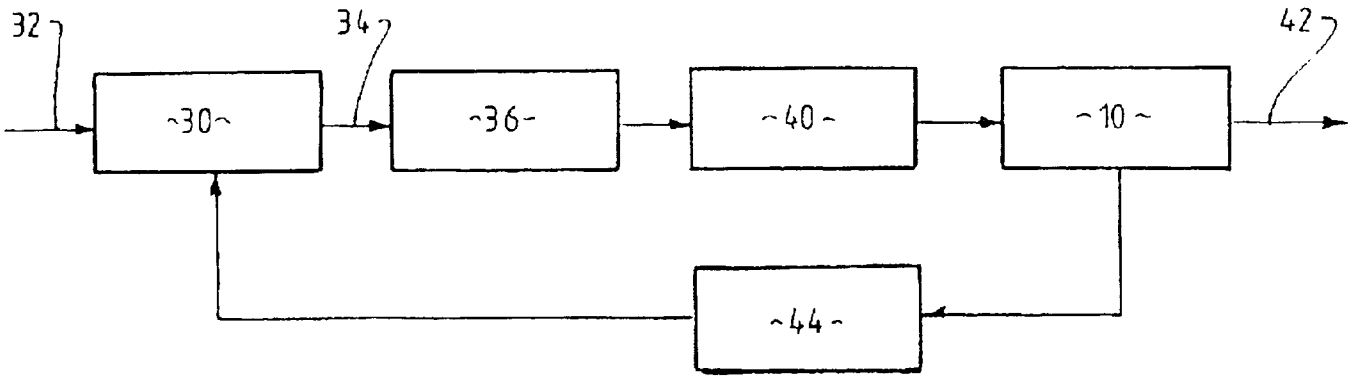
FIG. 6 is a block diagram of a control and feedback system used in accordance with the present invention.

Shown in FIG. 6 is a block diagram showing the relationship between the speed of the vehicle that has attached thereto the dispensing apparatus 2 and the speed at which the beads are finally dispensed after going through the apparatus 2. The vehicle speed is input to a comparator unit 30 which input signal may be a voltage or current signal translated in proportion to the speed of the vehicle, which speed may be taken from the drive shaft of the vehicle or alternately a sensor unit may detect the speed at which the vehicle moves relative to the road surface. The output signal from the comparator at output 34 is fed to a converter 36 which translates the voltage signal into an angular speed signal which the drum 10 should be rotating at and then this is fed into a controller unit 40 which depending upon inputs from a memory unit or microprocessor may control the rotational or angular speed of the drum 10 at 42. The input from a memory unit or microprocessor may provide values at which the speed of the drum is to rotate depending on the speed of the vehicle as represented by the corresponding angular speed that is input to the controller unit 40. The output to the rotor 10 is taken as the speed at which the beads are dispensed from the outlet means 20 at output 42. The speed of the rotor is also used as an output signal to be fed back to a converter unit 44 which may convert the angular speed of the rotor 10 into a voltage or current signal which is then fed back to the comparator unit 30 which comparator unit then compares the input vehicle speed and the corresponding rotor speed to make any necessary adjustments dependent on the variation in the input vehicle speed. Therefore the difference in speed values between the rotor 10 and vehicle may be input to the controller unit 40 to vary the speed of the rotor 10 as necessary. In order to obtain maximum reflectivity from both directions of travel along the road, the speed of the rotor 10 is about 10% faster than the speed of the vehicle.

A vehicle having attached thereto the dispensing apparatus 2 also has apparatus for dispensing paint or alternatively adhesive material to the road surface prior to the dispensing of the beads 4 from the apparatus 2. The paint or adhesive material may be water-based, solvent-based, thermoplastic, or any other suitable road line marking adhesive material. The paint to be used as the line marking is directly applied to the road surface as the vehicle travels along the road and shortly thereafter the beads 4 exit from the channels 45 to be placed in the wet or sticky paint surface. If the vehicle is travelling at a constant speed then the rotor 10 is set to a controlled number of revolutions that matches the road speed of the vehicle.

The distance between the road surface and the lowermost portion of outlet means 20 may ideally be in the range 150 mm to 200 mm. An optimum angle of 10 degrees from the horizontal is used for the cartridge 37, however a range of 5 degrees to 20 degrees would be satisfactory.

Figure 9:
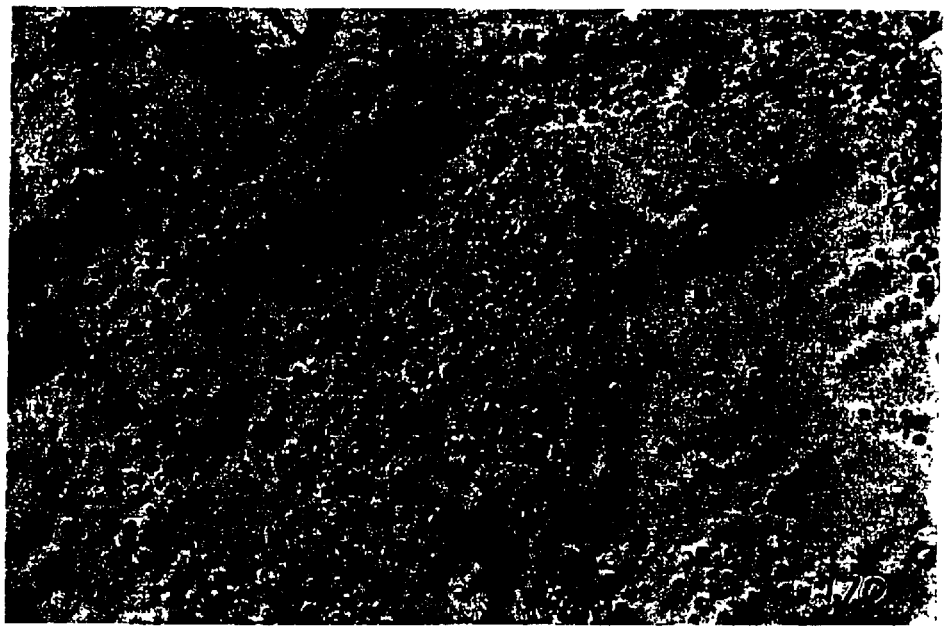
FIG. 9 is an enlarged photographic view of a conventional application of beads in accordance with prior art applied to a 20 mm chipseal surface at a speed of 15 kph.
Figure 10:
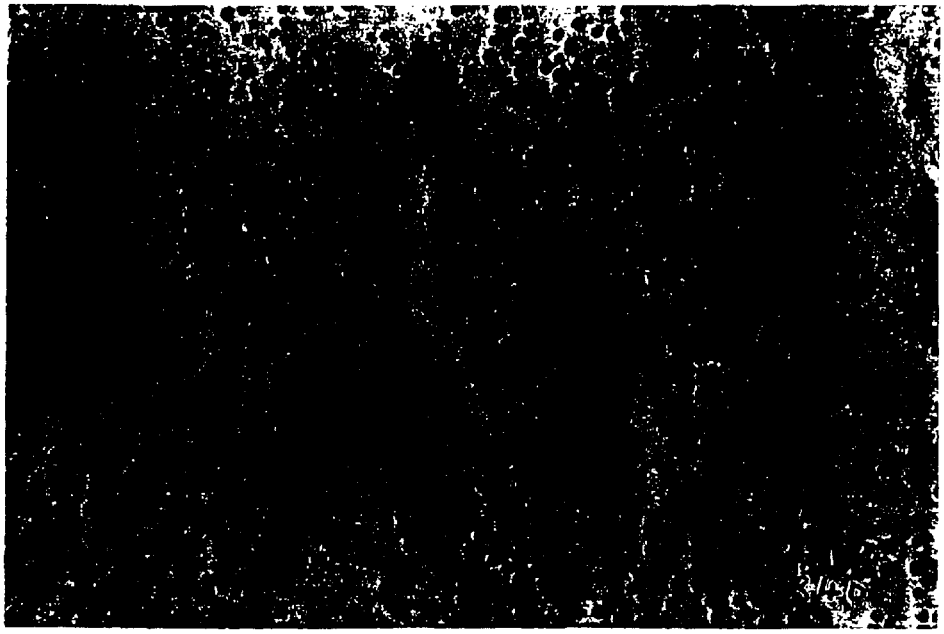
FIG. 10 is an enlarged photographic view of the application of reflective elements in accordance with the present invention applied to a chipseal road surface at 20 kph.

Referring to FIG. 9 there is shown the resultant bead formation in the paint line using conventional methods whereby the beads have been applied to a coarse 20 mm chip seal road surface at a speed of 15 kph. It is to be particularly noted the poor distribution of beads throughout the surface and the variability in depth that the beads lie at. As can be seen some are completely covered by the paint due to rolling through the paint solution. By comparison shown in FIG. 10 is the results of the beads in the paint line due to application of the present invention on a 20 mm coarse chip seal road surface with the vehicle speed being 20 kph. It is to be seen that there is a vast improvement in the distribution and required depth of the beads to allow an improved level of retro-reflectivity of the line marking.

Figure 11:
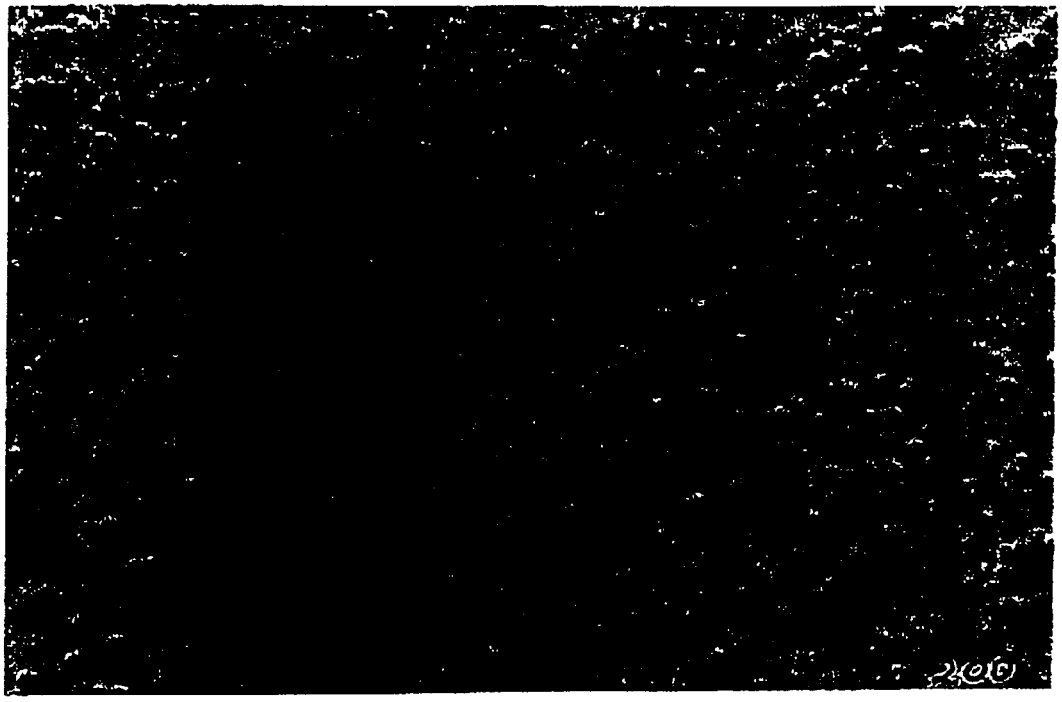
FIG. 11 is a photographic view showing the result of application of reflective elements to a smooth concrete surface at 15 kph in accordance with prior art.
Figure 12:
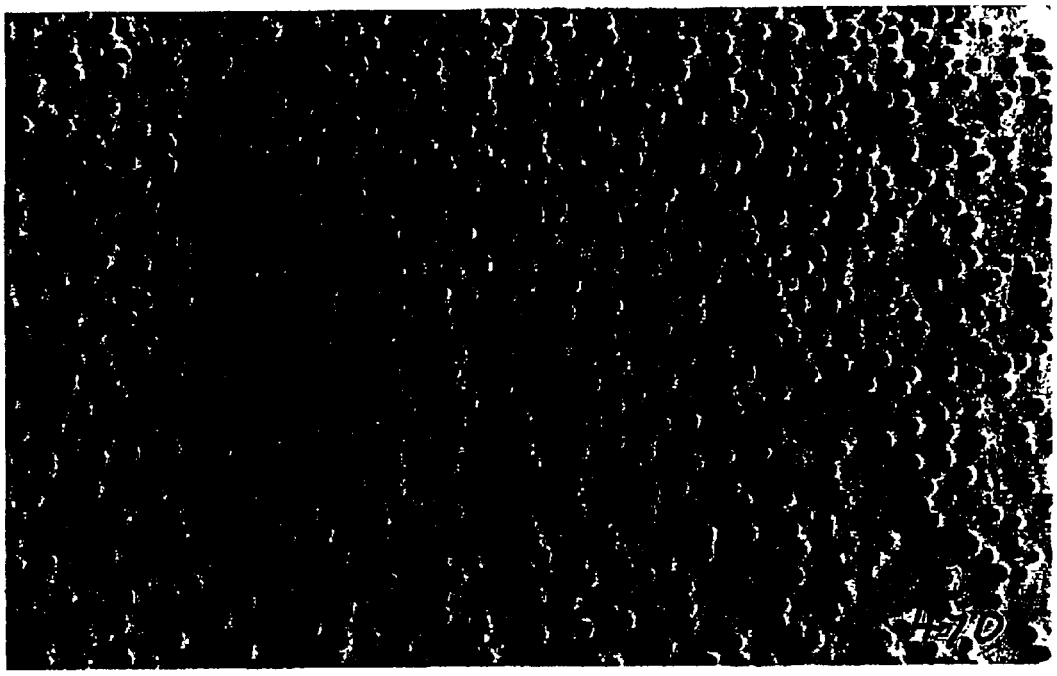
FIG. 12 is an enlarged photographic view showing the result of the application of reflective elements to a smooth concrete surface at 20 kph in accordance with the present invention.

Shown in FIG. 11 is the result of bead application using a conventional apparatus applied to a smooth concrete surface at 15 kph. Again it is clearly seen that the bead distribution and depth at which the beads are placed in the paint solution vary greatly providing a poor retro-reflectivity level. By comparison in FIG. 12 which is the result of application of beads to the paint line marking surface as a result of the present invention when applied also to a smooth concrete surface but at 20 kph. It is clearly evident that there is improvement in the placement of the beads and therefore the distribution and depth that they are placed at. This is translated into a vastly improved two-fold or three-fold reflectivity in night time driving conditions.

Figure 7:
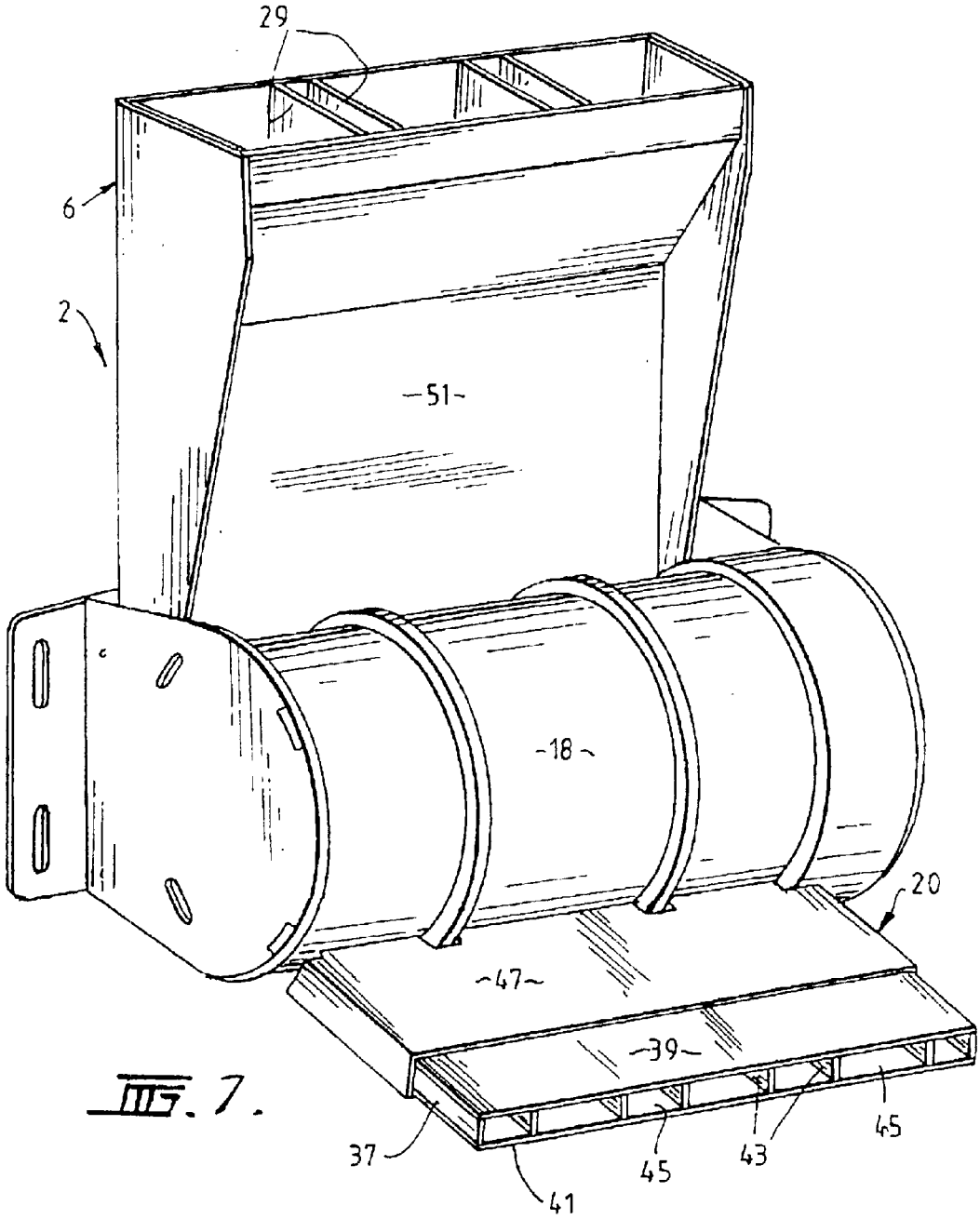
FIG. 7 is a perspective view of the dispensing apparatus.

Shown in FIG. 7 is the dispensing apparatus 2 with cover panel 51 closing off the chutes 31 from the front. It is contoured to fit between the outermost partitions and abut against the inner partitions. Beads 4 are placed into the apertures 7, and then under gravity enter the template 8 into gap 14 and then out of the respective channels 45 in the cartridge 37 of the outlet means 20 and from there dispensed into the painted line.

Figure 8:
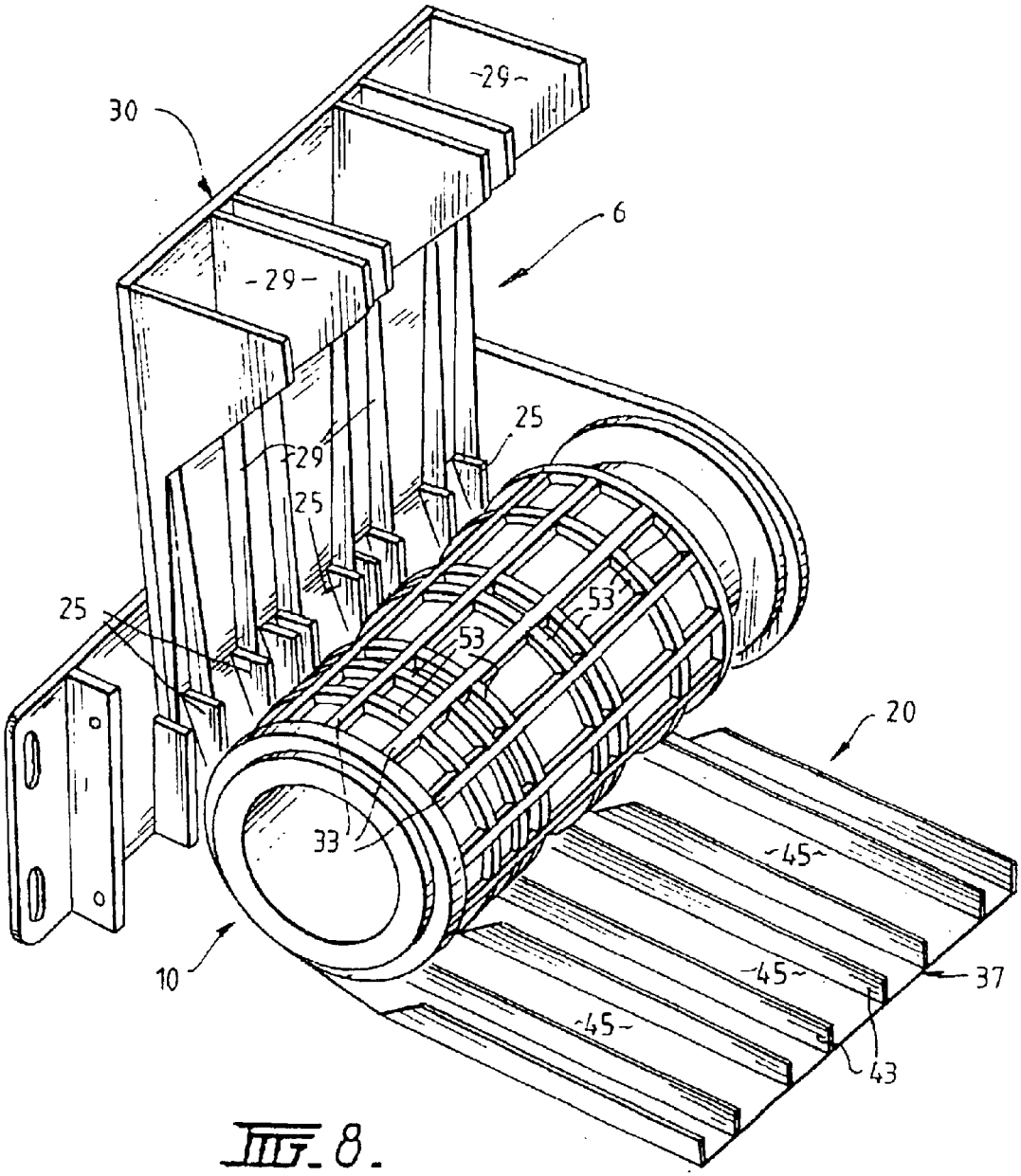
FIG. 8 is a perspective view of the dispensing apparatus with cover plates removed.

FIG. 8 illustrates the dispensing apparatus 2 with cover plate 51, housing 18, top plate 39 of cartridge 37 and housing 47 removed. In addition to the longitudinal ribs 33 there is shown radial ribs 53 extending transversely of the ribs 33 and circumferentially around the rotor 10. The ribs 53 assist in guiding and separating the beads 4 as they enter gap 14.

The present invention provides a greatly improved method and dispensing apparatus for applying reflective elements such as glass beads to a surface and in particular to a road surface. The present invention substantially improves the control of the placement of the reflective elements together with the roll and bounce of the reflective elements during application to the road surface. As a result greater reflectivity is achieved at night which is particularly important for wet road conditions and also provides excellent placement for better durability and wear. Directional bias is substantially eliminated in the road line due to the direction of application as the beads exiting the outlet means 20 substantially have no velocity imparted on them which provides for better placement in the paint surface. This in turn provides more reflective elements to produce brighter retro-reflectivity.

Furthermore line vehicle marking speeds are increased which reduces the application costs. As a vehicle driver, the present invention provides an increased road preview time so that the driver can more easily detect the edge or middle of the roads together with the end of line detection distance so that the driver can make a decision, for example as to whether to overtake or not. The loss of glass beads due to bounce and roll is also minimised by the present invention and effectively reduces the whole of life cost to line marking and enhances road safety at night in both dry and wet conditions.

It will also be appreciated that various modifications and alterations may be made to the preferred embodiments above, without departing from the scope and spirit of the present invention.

What is claimed is:

1. Dispensing apparatus for dispensing visual indication means onto a surface, said apparatus being attached to a vehicle and said visual indication means being applied to a previously marked region on said surface, said dispensing apparatus comprising:

inlet means for receiving said visual indication means;

outlet means for dispensing said visual indication means onto said surface;

drive means including a rotor arranged in a rotor housing for driving said visual indication means along a path from said inlet means to said outlet means such that said visual indication means contact a surface of said drive means thereby imparting a predetermined velocity to said visual indication means;

wherein said visual indication means exit said outlet means at a velocity that has a magnitude substantially the same as the magnitude of velocity at which said vehicle travels and a direction that is substantially opposite to the direction of travel of said vehicle.

2. Dispensing apparatus according to claim 1 wherein said visual indication means comprises reflective elements.

3. Dispensing apparatus according to claim 2 wherein said reflective elements are glass beads.

4. Dispensing apparatus according to claim 1 wherein said visual indication means travel from said inlet means to said outlet means along said path between said rotor and said rotor housing such that said visual indication means contact an outer surface of said rotor.

5. Dispensing apparatus according to claim 4 wherein said outer surface of said rotor includes ribs extending substantially parallel to a longitudinal axis of said rotor in order to assist the movement of said visual indication means along said path.

6. Dispensing apparatus according to claim 1 further comprising a feedback circuit for adjusting the angular speed of said drive means to impart an exit velocity to said visual indication means that is substantially the same in magnitude to the velocity of travel of said vehicle.

7. Dispensing apparatus according to claim 6 wherein said feedback circuit accepts a vehicle speed measurement signal and controls the angular speed of said drive means in accordance with said vehicle speed measurement signal.

8. Dispensing apparatus according to claim 7 wherein said feedback circuit includes comparator means for comparing said vehicle speed measurement signal with a drive means speed signal resulting in a comparator output signal representing the difference between said vehicle speed measurement signal and said drive means speed signal, said feedback circuit adjusting the speed of said drive means based on said comparator output signal.

9. Dispensing apparatus according to claim 7 wherein said feedback circuit has a controller means which receives said vehicle speed measurement signal or said comparator output signal and adjusts said drive means speed according to a processing unit that stores equivalent angular speed values at which said drive means should be rotating.

10. Dispensing apparatus according to claim 1 wherein said inlet means is adjacent said drive means and directs said visual indication means into said path.

11. Dispensing apparatus according to claim 10 wherein said inlet means includes a template having adjustable partitions that allow variation in width of spaces through which said visual indication means travel so as to control the width and separation of said visual indication means as they contact said surface.

12. Dispensing apparatus according to claim 11 wherein said template is adjacent said drive means at one end of said inlet means and said partitions extend to form chutes to an end opposite to said one end thereby extending said spaces through which said visual indication means travel toward said drive means.

13. Dispensing apparatus according to claim 1 wherein said outlet means extends from said drive means.

14. Dispensing apparatus according to any one of claim 13 wherein said outlet means includes a series of channels adjustable in width and separated from each other by partitions.

15. Dispensing apparatus according to claim 14 wherein said channels are aligned with spaces in said template of said inlet means.

16. Dispensing apparatus according to claim 13 wherein said outlet means extends downwardly from said drive means at a predetermined angle and has an outer edge at a predetermined height above said surface.

17. Dispensing apparatus according to claim 1 wherein said previously marked region is one or more lines made from an adhesive material and said surface is a road surface.

18. A vehicle having mounted thereon a dispensing apparatus according to claim 1.

19. A method of applying visual indication means to a surface from a moving vehicle, wherein said visual indication means are dispensed from a dispensing apparatus attached to said vehicle, said method comprising the steps of:

loading said visual indication means to said dispensing apparatus;

imparting a predetermined velocity to said visual indication means through a drive means, said drive means driving said visual indication means along a path from inlet means of said dispensing apparatus to outlet means of said dispensing apparatus such that said visual indication means contact a surface of said drive means;

dispensing said visual indication means from said drive means onto a previously marked region of said surface;

such that the exit velocity of said visual indication means from said dispensing apparatus is substantially the same in magnitude as the velocity of travel of said vehicle but substantially opposite in direction to the direction of travel of said vehicle; and applying a material capable of adhesion to said surface prior to the dispensing of said visual indication means so as to form said previously marked region.

20. A method according to claim 19 further comprising the step of controlling the speed of said drive means in accordance with the velocity of the vehicle.

21. A method according to claim 20 further comprising the step of adjusting said speed of said drive means in order to substantially match said exit velocity to the velocity of travel of said vehicle.

22. A method according to claim 21 wherein said adjusting step is based on a received measurement signal indicative of the speed of travel of said vehicle.

23. A method according to claim 21 wherein said adjusting step is performed via a feedback circuit based on a difference signal between a received measurement signal indicative of the speed of travel of said vehicle and said speed of the drive means.

24. A method according to claim 22 wherein said adjusting step is performed such that said speed of said drive means is controlled in accordance with stored data representing the speed at which said drive means should be operating given said received measurement signal or said difference signal.

25. A method according to claim 19, wherein said material capable of adhesion to said surface is paint.

26. Dispensing apparatus for dispensing visual indication means onto a surface, said apparatus being attached to a vehicle and said visual indication means being applied to a previously marked region on said surface, said dispensing apparatus comprising:

inlet means for receiving said visual indication means;

outlet means for dispensing said visual indication means onto said surface;

drive means driving said visual indication means along a path from said inlet means to said outlet means such that said visual indication means contact a surface of said drive means thereby imparting a predetermined velocity to said visual indication means; and a feedback circuit for adjusting the angular speed of said drive means wherein said visual indication means exit said outlet means at a velocity that has a magnitude substantially the same as the magnitude of velocity at which said vehicle travels and a direction that is substantially opposite to the direction of travel of said vehicle.

27. Dispensing apparatus for dispensing visual indication means onto a surface, said apparatus being attached to a vehicle and said visual indication means being applied to a previously marked region on said surface, said dispensing apparatus comprising:

inlet means for receiving said visual indication means, said inlet means includes a template having adjustable partitions that allow variation in width of spaces through which said visual indication means travel so as to control the width and separation of said visual indication means as they contact said surface;

outlet means for dispensing said visual indication means onto said surface; and a drive means for driving said visual indication means along a path from said inlet means to said outlet means such that said visual indication means contact a surface of said drive means thereby imparting a predetermined velocity to said visual indication means, wherein said visual indication means exit said outlet means at a velocity that has a magnitude substantially the same as the magnitude of velocity at which said vehicle travels and a direction that is substantially opposite to the direction of travel of said vehicle and wherein said inlet means is adjacent said drive means and directs said visual indication means into said path and wherein said template is adjacent said drive means at one end of said inlet means and said partitions extend to form chutes to an end opposite to said one end thereby extending said spaces through which said visual indication means travel toward said drive means.

28. Dispensing apparatus for dispensing visual indication means onto a surface, said apparatus being attached to a vehicle and said visual indication means being applied to a previously marked region on said surface, said dispensing apparatus comprising:

inlet means for receiving said visual indication means, outlet means for dispensing said visual indication means onto said surface, wherein said outlet means includes a series of channels adjustable in width and separated from each other by partitions;

drive means for driving said visual indication means along a path from said inlet means to said outlet means such that said visual indication means contact a surface of said drive means thereby imparting a predetermined velocity to said visual indication means;

wherein said visual indication means exit said outlet means at a velocity that has a magnitude substantially the same as the magnitude of velocity at which said vehicle travels and a direction that is substantially opposite to the direction of travel of said vehicle and wherein said outlet means extends from said drive means.

29. Dispensing apparatus for dispensing visual indication means onto a surface, said apparatus being attached to a vehicle and said visual indication means being applied to a previously marked region on said surface, said dispensing apparatus comprising:

inlet means for receiving said visual indication means;

outlet means for dispensing said visual indication means onto said surface;

drive means for driving said visual indication means along a path from said inlet means to said outlet means such that said visual indication means contact a surface of said drive means thereby imparting a predetermined velocity to said visual indication means;

wherein said visual indication means exit said outlet means at a velocity that has a magnitude substantially the same as the magnitude of velocity at which said vehicle travels and a direction that is substantially opposite to the direction of travel of said vehicle and wherein said previously marked region is one or more lines made from an adhesive material and said surface is a road surface.

30. A method of applying visual indication means to a surface from a moving vehicle, wherein said visual indication means are dispensed from a dispensing apparatus attached to said vehicle, said method comprising the steps of:

loading said visual indication means to said dispensing apparatus;

imparting a predetermined velocity to said visual indication means through a drive means, said drive means driving said visual indication means along a path from inlet means of said dispensing apparatus to outlet means of said dispensing apparatus such that said visual indication means contact a surface of said drive means;

dispensing said visual indication means from said drive means onto a previously marked region of said surface;

controlling the speed of said drive means in accordance with the velocity of the vehicle; and adjusting said speed of said drive means such that the exit velocity of said visual indication means from said dispensing apparatus is substantially the same in magnitude as the velocity of travel of said vehicle but substantially opposite in direction to the direction of travel of said vehicle, wherein said adjusting step is performed via a feedback circuit based on a difference signal between a received measurement signal indicative of the speed of travel of said vehicle and said speed of the drive means.

* * * * *

UNITED STATES PATENT AND TRADEMARK OFFICE

CERTIFICATE OF CORRECTION

PATENT NO. : 6,796,740 B2
DATED : September 28, 2004
INVENTOR(S) : Chiron et al.

It is certified that error appears in the above-identified patent and that said Letters Patent is hereby corrected as shown below:

Column 9,
Lines 7 and 8, delete "according to any one of claim 13," and inser therefor
-- according to claim 13 --.
Lines 37-43, delete
"dispensing said visual indication means from said drive means onto a previously marked region of said surface;

such that the exit velocity of said visual indication means from said dispensing apparatus is substantially the same in magnitude as the velocity of travel of said vehicle but substantially opposite in direction to the direction of travel of said vehicle; and"

and insert therefor:

-- dispensing said visual indication means from said drive means onto a previously marked region of said surface such that the exit velocity of said visual indication means from said dispensing apparatus is substantially the same in magnitude as the velocity of travel of said vehicle but substantially opposite in direction to the direction of travel of said vehicle; and --.

Signed and Sealed this

Twenty-second Day of February, 2005

JON W. DUDAS
*Director of the United States Patent and Trademark Office*